US009144333B2

(12) United States Patent
Lazorchak

(10) Patent No.: US 9,144,333 B2
(45) Date of Patent: Sep. 29, 2015

(54) FOOD SERVING CONTAINER HAVING AN ATTACHABLE TEMPERATURE ALTERING INSERT

(71) Applicant: Andrew Lazorchak, Yountville, CA (US)

(72) Inventor: Andrew Lazorchak, Yountville, CA (US)

( * ) Notice: Subject to any disclaimer, the term of this patent is extended or adjusted under 35 U.S.C. 154(b) by 0 days.

(21) Appl. No.: 14/201,819

(22) Filed: Mar. 8, 2014

(65) Prior Publication Data

US 2015/0014331 A1 Jan. 15, 2015

Related U.S. Application Data

(60) Provisional application No. 61/957,700, filed on Jul. 11, 2013.

(51) Int. Cl.

| | |
|---|---|
| ***F25D 3/08*** | (2006.01) |
| ***A47G 19/02*** | (2006.01) |
| ***B65D 81/18*** | (2006.01) |
| ***A47G 19/22*** | (2006.01) |

(52) U.S. Cl.

CPC ..... *A47G 19/027* (2013.01); *A47G 19/2288* (2013.01); *B65D 81/18* (2013.01)

(58) Field of Classification Search

CPC ..... F25D 2303/0841; F25D 31/002; F25D 31/003; F25D 31/008; F25D 31/006; F25D 2303/0845

USPC ..... 62/457.3, 457.8, 529, 530, 293; 220/592.16, 592.17

See application file for complete search history.

(56) References Cited

U.S. PATENT DOCUMENTS

| | | | | |
|---|---|---|---|---|
| 5,653,124 | A * | 8/1997 | Weber | 62/457.4 |
| 6,382,450 | B1 * | 5/2002 | De Rosa et al. | 220/230 |
| 2004/0177642 | A1 * | 9/2004 | Citrynell et al. | 62/457.3 |
| 2008/0164269 | A1 * | 7/2008 | Vorderkunz | 220/739 |

* cited by examiner

*Primary Examiner* — Cassey D Bauer
(74) *Attorney, Agent, or Firm* — John M. Brandt

(57) ABSTRACT

A food container suitable for home entertainment and dining purposes having a chamber for containing a temperature altering device or insert and apparatus to secure the device within the chamber during use, the container arranged for convenient and rapid exchange of pre-cooled or pre-heated inserts by providing magnetically coupled base units to retain the inserts.

3 Claims, 4 Drawing Sheets

FOOD SERVING CONTAINER HAVING AN ATTACHABLE TEMPERATURE ALTERING INSERT

CROSS REFERENCE TO RELATED APPLICATIONS

This application is based on a provisional application Ser. No. 61/957,700 filed Jul. 11, 2013, which is hereby incorporated by reference.

BACKGROUND OF THE INVENTION

1. Field of the Invention

The invention resides in the field of food containers and more particularly relates to those having ancillary devices intended to provide heating or cooling of the container contents.

2. Description of the Prior Art

Disclosures of food containers having temperature altering inserts to cool or warm the contents of the containers are known in the prior art. Many of these relate to cooling arrangements for beverage containers to extend the time the beverage therein will reach ambient temperature when carried away from a home or other preparatory environment.

The inserts are held within the containers by, for example, friction plugs or threaded cap assemblies. The container tops are also sealed to prevent spillage when the container is moved about for later use, for example, in a lunch box, back pack, or while running or exercising. Examples of U.S. patents are U.S. Pat. No. 5,467,877, Smith; U.S. Pat. No. 5,597,087, Vinarsky; U.S. Pat. No. 6,598,418, Holley, Jr.; and US publication US2012/0298675, Archie, Jr.

In contrast to the prior art, the invention disclosed herein is directed to use in a home or restaurant, dining, or entertainment environment where it is desired to maintain a beverage or other food in a continually chilled or warmed state by providing a convenient and rapid means for exchanging the insert as the container and contents evolve toward ambient temperature.

The prior art devices known to applicant do not facilitate this goal as friction plugs, threaded cap assemblies, and the like require relatively vigorous action for removal. The open top containers for which the invention is primarily designed also present the possibility of spillage during the exchange process. This invention solves the above problems as described below.

SUMMARY OF THE INVENTION

The invention may be summarized as a food container suitable for use in a home, restaurant, or other entertainment environment which container has a chamber a chamber for containing a temperature altering device or insert and apparatus to secure the insert within the chamber during use. The container is arranged for convenient and rapid exchange of pre-cooled or pre-heated inserts by utilizing magnetically coupled base units to retain the inserts.

The greater portion of the containers are similar or identical to standard serving utensils such as beverage glasses of all sizes and shapes, cups for coffee, soups, and the like, and bowls and serving dishes for dining fare. The body of the container is essentially a sleeve of a desired shape open at the top and bottom. An upper base assembly with a section forming a chamber for holding the inserts is attached to the bottom end of the sleeve, the chamber protruding into the interior of the sleeve. The attachment design seals the base and sleeve bottom against leakage. A mutually engagable threaded sleeve bottom and base with appropriate gaskets has been found to work well.

A second lower base secures an insert which fits within the chamber and is secured to the first base by one or more pairs of aligned magnets of opposite polarity separately disposed in the bases. When the magnets are oriented opposite one another, the insert will be secured in the chamber. By rotating one base in relation to the other, thereby misaligning the magnet pairs, the magnetic attraction is diminished allowing the bases to be separated and a fresh insert substituted for the one in use. The inserts may be separate structures or integrated with the second base as a unit.

Additionally, an insulating sleeve may be added to the outside of the container and a coaster disposed on the underside of the lower base.

These and other features and advantages of the invention will be come more clear from the following description of the preferred embodiment taken with the drawings which follows.

DESCRIPTION OF THE PREFERRED EMBODIMENT

Figure 1:
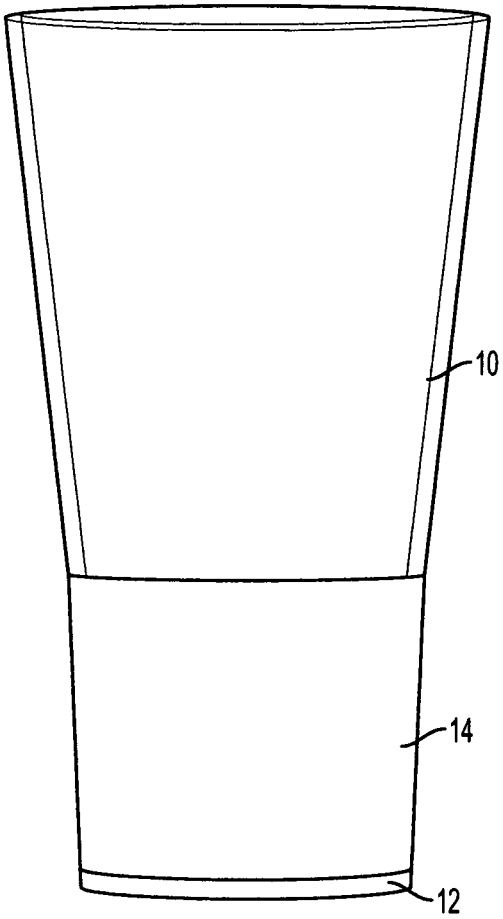
FIG. 1 is an elevation view of the preferred embodiment of the invention.

Referring to FIG. 1, an elevation view of a preferred embodiment of the invention is shown in which a beverage container, a glass, 10 is supported by base configuration 12 and surrounded by an insulating sleeve 14.

Figure 2:
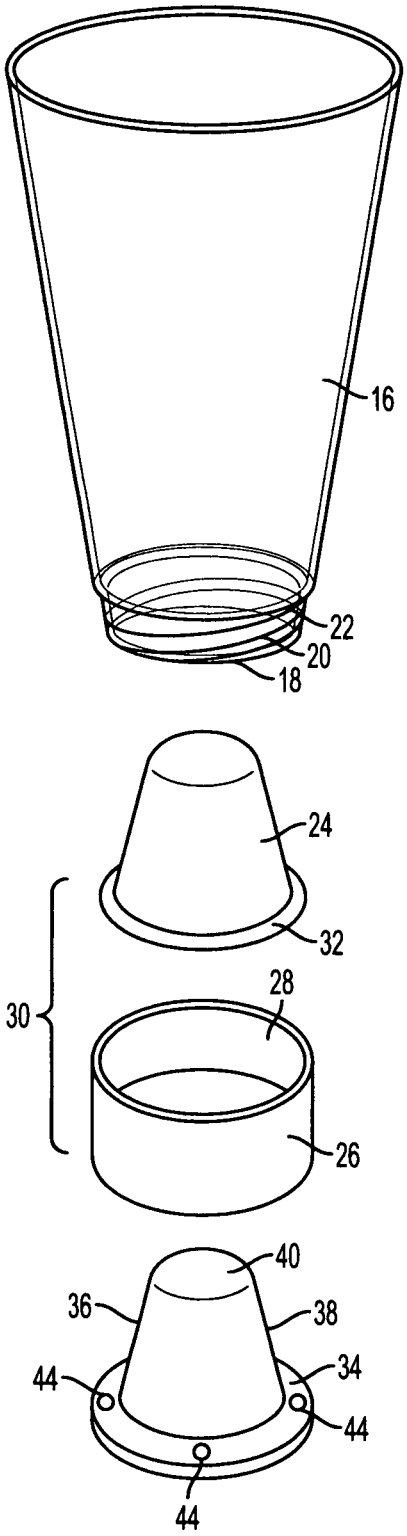
FIG. 2 is an exploded perspective view of the preferred embodiment of the invention.

FIG. 2 illustrates in perspective format the components of the invention arranged in order of assembly. Sleeve 16 forms the wall of the container and has at the bottom an indented portion 18 with externally molded threads 20 and an upper lip 22 for supporting a sealing gasket.

Chamber 24 composed of, for example, stainless steel, and flange 26 having internal threads 28 comprise an upper base assembly 30 and may constitute separate components as shown or attached together as an integrated unit. Threaded flange 26 joins with threaded sleeve portion 18 to secure chamber 24 inside sleeve 16 sealing the bottom of the sleeve to form the container using gaskets in conjunction with flared lower portion 32 of chamber 24.

Lower base 34 supports cooling insert 36 comprised of, for example, a food grade plastic outer shell 38 encapsulating a food grade freezable gel 40.

Figure 3:
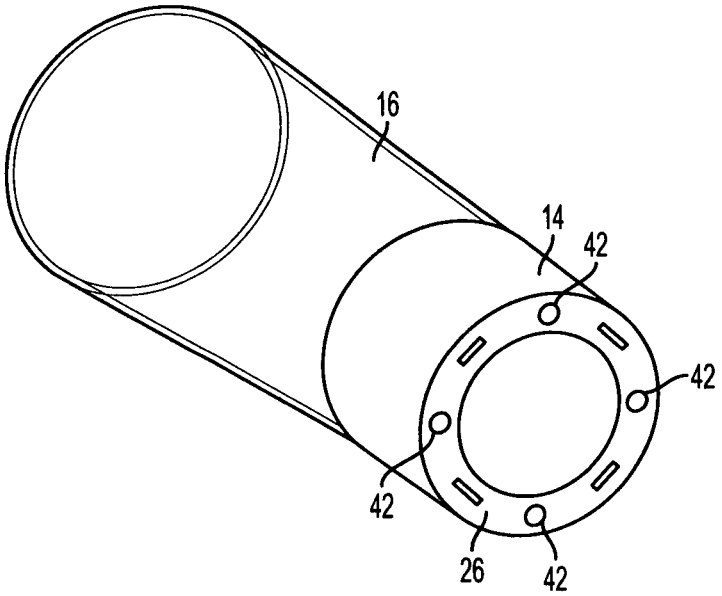
FIG. 3 is a perspective end view of the preferred embodiment of the invention.
Figure 4:
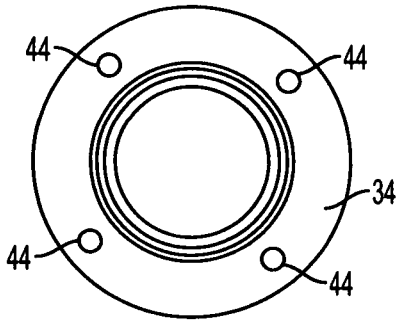
FIG. 4 is a top view of one component of the preferred embodiment of the invention.

Magnets 42 and 44 of opposite polarity are disposed in the bottom surface of flange 26 in a selected pattern as shown in FIG. 3 and in an opposed matching pattern in lower base 34 as shown in FIG. 4. The magnets may be exposed at the surface or imbedded inside the non-magnetic structure of flange 26 or base 34. When the magnets are aligned by the appropriate orientation of the bases, base 34 will be tightly held against flange 26 by the mutual attraction of the magnets which in turn will secure cooling insert inside chamber 24. The lower temperature of gel 40 will then transfer through the chamber wall to cool the contents within the container.

Figure 5:
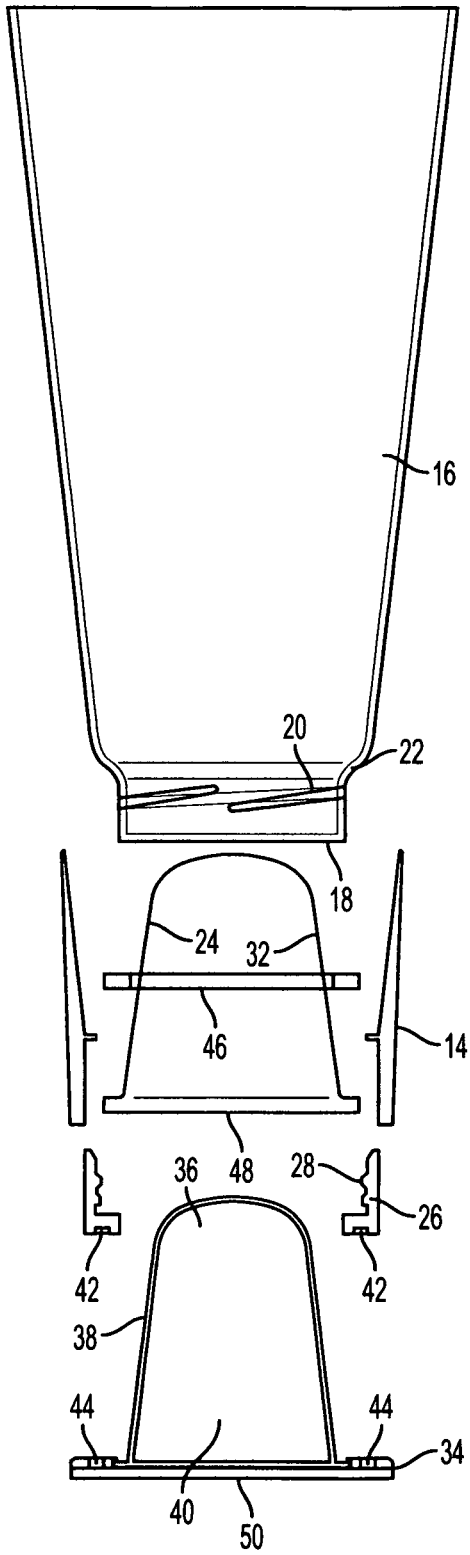
FIG. 5 is an exploded cross-sectional view of the preferred embodiment of the invention.

FIG. 5 is a schematic cross-sectional view illustrating the components described above and in addition gaskets 46 and 48 positioned on the top and bottom of the flared section 32 of chamber 24 to seal the container between sleeve lip 22 and flange 26. Coaster 50 is positioned on the bottom of lower base 34 and acts to protect the surface of the support such as a table and also to provide a partial gripping interface for rotating the container and upper base against the lower base to break or establish the magnetic attraction of magnets 42 and 44.

In use, sleeve 16 and upper base assembly 30 are attached to function as a unit and lower base 34 and insert 36 are attachable to the above by establishing alignment of the magnets in the bases. Inserts are placed in a chilling environment such as a freezer or refrigerator or if a warming function is desired in a microwave oven.

The inserts of lower or elevated temperature are then transferred as needed, placed within the container chamber and secured by reestablishing by magnet alignment the magnetic force between the upper and lower bases.

The invention is accordingly defined by the following claims.

What is claimed is:

1. A liquid serving container having an attachable temperature altering insert comprising in combination:

A. a sleeve forming the walls of said container, the interior of said sleeve arranged to be in direct contact with said liquid, said sleeve having an upper end and a threaded lower end;

B. a first base assembly, said assembly having threads arranged to cooperate with said sleeve threaded lower end to attach said first base assembly to said sleeve lower end, said first base assembly having a chamber member extending within the interior of said sleeve;

C. gasket means disposed between said sleeve lower end and said first base assembly arranged to seal said sleeve and prevent any of said liquid from escaping said sleeve lower end thereby forming said container;

D. a temperature altering member insertable into said chamber member;

E. a second base assembly arranged to interface with said first base assembly, said second base assembly arranged to secure said temperature altering member within said chamber; and F. magnetic coupling means disposed in each of said first and second base assemblies, said magnetic coupling means arranged to mutually attract and hold one another, said base assemblies, and said temperature altering member together when said first and second base assemblies are positioned such that said magnetic coupling means are in alignment.

2. The liquid serving container of claim 1 further including a coaster disposed beneath said second base assembly.

3. The liquid serving container of claim 1 further including an insulating sleeve disposed on the exterior wall of said sleeve.

* * * * *